US011370638B2

(12) United States Patent
Kondo et al.

(10) Patent No.: US 11,370,638 B2
(45) Date of Patent: Jun. 28, 2022

(54) ELEVATOR DOOR BYPASS DEVICE

(71) Applicant: MITSUBISHI ELECTRIC CORPORATION, Chiyoda-ku (JP)

(72) Inventors: Shingo Kondo, Chiyoda-ku (JP); Takehiko Kubota, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 916 days.

(21) Appl. No.: 16/082,387

(22) PCT Filed: Apr. 26, 2016

(86) PCT No.: PCT/JP2016/063031
§ 371 (c)(1),
(2) Date: Sep. 5, 2018

(87) PCT Pub. No.: WO2017/187507
PCT Pub. Date: Nov. 2, 2017

(65) Prior Publication Data

US 2019/0062110 A1 Feb. 28, 2019

(51) Int. Cl.
*B66B 5/00* (2006.01)
*B66B 13/14* (2006.01)
*B66B 13/22* (2006.01)

(52) U.S. Cl.
CPC ..... *B66B 5/0018* (2013.01); *B66B 5/00* (2013.01); *B66B 5/0043* (2013.01); *B66B 13/14* (2013.01); *B66B 13/22* (2013.01)

(58) Field of Classification Search
CPC ..... B66B 1/468; B66B 1/2408; B66B 1/3461; B66B 1/3492; B66B 19/007;
(Continued)

(56) References Cited

U.S. PATENT DOCUMENTS 6,223,861 B1 * 5/2001 Sansevero ..... B66B 13/22 187/316
2007/0181377 A1 * 8/2007 Ketonen ..... B66B 13/285 187/314
2020/0062543 A1 * 2/2020 Tracey ..... B66B 5/0031

FOREIGN PATENT DOCUMENTS

JP 10-17233 A 1/1998
JP 2008-156092 A 7/2008
JP 4515742 B2 8/2010

OTHER PUBLICATIONS

International Search Report dated Jul. 19, 2016, in PCT/JP2016/063031 filed Apr. 26, 2016.
(Continued)

*Primary Examiner* — Jeffrey Donels
(74) *Attorney, Agent, or Firm* — Oblon, McClelland, Maier & Neustadt, L.L.P.

(57) ABSTRACT

An elevator door bypass apparatus, configured to bypass a landing door or a car door at a time of an inspection of an elevator, includes: a door mode selector switch configured to switch a door mode between a normal operation and a bypass operation; a bypass target selector switch configured to switch between bypassing of the landing door and bypassing of the car door; and a bypass relay configured to, in a case that the door mode has been switched to the bypass operation by the door mode selector switch, bypass the landing door when the bypassing of the landing door has been selected by the bypass target selector switch, and bypass the car door when the bypassing of the car door has been selected by the bypass target selector switch.

8 Claims, 2 Drawing Sheets

(58) Field of Classification Search
CPC ..... B66B 2201/101; B66B 2201/4623; B66B 2201/463; B66B 2201/4638; B66B 2201/4653
See application file for complete search history.

(56) References Cited

OTHER PUBLICATIONS

Office Action dated Jun. 25, 2019 in Japanese Patent Application No. 2018-513980 (with unedited computer generated English translation) 8 pages.

* cited by examiner

ELEVATOR DOOR BYPASS DEVICE

TECHNICAL FIELD

The present invention relates to an elevator door bypass apparatus configured to bypass, that is, short-circuit a landing door or a car door at a time of an inspection of an elevator.

BACKGROUND ART

Hitherto, there has been known an elevator failure detection apparatus configured as follows. Even in a case where a car door has been fully opened, when a car door closing switch or a landing door closing switch is closed, it is detected that any one of those door closing switches is short-circuited, and the detection of the short-circuiting is stored. In a case where the car door has been fully opened, when the car door closing switch and the landing door closing switch are opened, it is detected that those door closing switches are not short-circuited, and storage of short-circuiting of the door closing switch is cleared. Further, a car is prevented from being started until the stored content of short-circuiting of the door closing switch is cleared by output for clearing the storage of short-circuiting of the door closing switch (see, for example, Patent Literature 1).

CITATION LIST

Patent Literature

[PTL 1] JP 4515742 B2

SUMMARY OF INVENTION

Technical Problem

In recent years, for the purpose of maintenance of contacts of a landing door, a car door, and door locks, it has been required that a door bypass apparatus configured to bypass a landing door and a car door be provided, and the following conditions have been stipulated for functions of the door bypass apparatus.

a) Normal operation control is disabled.

b) The contacts of the landing door and the car door can be bypassed.

c) The contact of the car door and the contact of the landing door cannot be bypassed at the same time.

d) In order to operate a car under a state in which the contact of the car door is bypassed, an independent monitoring signal for checking whether the car door is fully closed is provided.

e) (This condition is a condition for a manual landing door, and is thus not applied in this case.)

f) The car can be operated only at a time of an inspection operation or at a time of an emergency electric operation.

g) During the operation, an audible signal in the car and a flashlight below the car are actuated.

However, there is a problem in the elevator failure detection apparatus described in Patent Literature 1 in that, although the car can be prevented from being started until the stored content of short-circuiting of the door closing switch is cleared by the output for clearing the storage of short-circuiting of the door closing switch, the above-mentioned requirements are not satisfied.

The present invention has been made in order to solve the above-mentioned problem, and it is an object of the present invention to provide an elevator door bypass apparatus capable of satisfying the requirements for bypassing of a landing door and a car door with an inexpensive configuration.

Solution to Problem

According to one embodiment of the present invention, there is provided an elevator door bypass apparatus, which is configured to bypass a landing door or a car door at a time of an inspection of an elevator, the elevator door bypass apparatus including: a door mode selector switch configured to switch a door mode between a normal operation and a bypass operation; a bypass target selector switch configured to switch between bypassing of the landing door and bypassing of the car door; and a bypass relay configured to, in a case where the door mode has been switched to the bypass operation by the door mode selector switch, bypass the landing door when the bypassing of the landing door has been selected by the bypass target selector switch, and bypass the car door when the bypassing of the car door has been selected by the bypass target selector switch.

Advantageous Effects of Invention

According to the elevator door bypass apparatus of one embodiment of the present invention, in the case where the door mode has been switched to the bypass operation by the door mode selector switch, the bypass relay bypasses the landing door when the bypassing of the landing door has been selected by the bypass target selector switch. Further, in the case where the door mode has been switched to the bypass operation by the door mode selector switch, the bypass relay bypasses the car door when the bypassing of the car door has been selected by the bypass target selector switch.

It is therefore possible to satisfy the requirements for the bypassing of the landing door and the car door with an inexpensive configuration.

DESCRIPTION OF EMBODIMENTS

Figure 1:
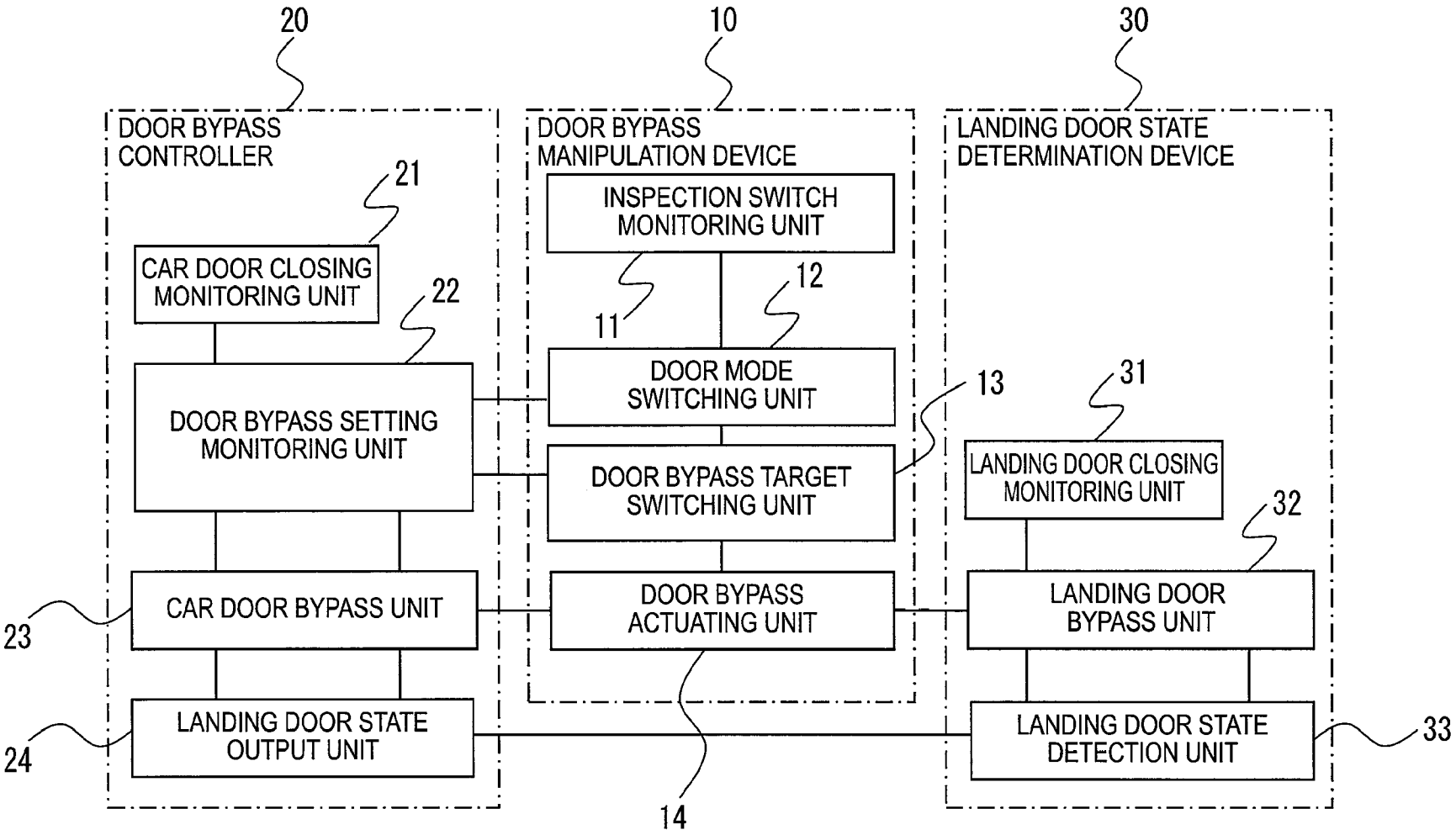
FIG. 1 is a block configuration diagram for illustrating an elevator door bypass apparatus according to a first embodiment of the present invention.

Now, a description is given of an elevator door bypass apparatus according to a preferred embodiment of the present invention with reference to the drawings, in which the same or corresponding components are denoted by the same reference numerals to describe the components.

First Embodiment

FIG. 1 is a block configuration diagram for illustrating an elevator door bypass apparatus according to a first embodiment of the present invention. In FIG. 1, the elevator door bypass apparatus includes a door bypass manipulation device 10, a door bypass controller 20, and a landing door state determination device 30.

The door bypass manipulation device 10 includes an inspection switch monitoring unit 11, a door mode switching unit 12, a door bypass target switching unit 13, and a door bypass actuating unit 14. Further, the door bypass controller 20 includes a car door closing monitoring unit 21, a door bypass setting monitoring unit 22, a car door bypass unit 23, and a landing door state output unit 24. Further, the landing door state determination device 30 includes a landing door closing monitoring unit 31, a landing door bypass unit 32, and a landing door state detection unit 33.

Figure 2:
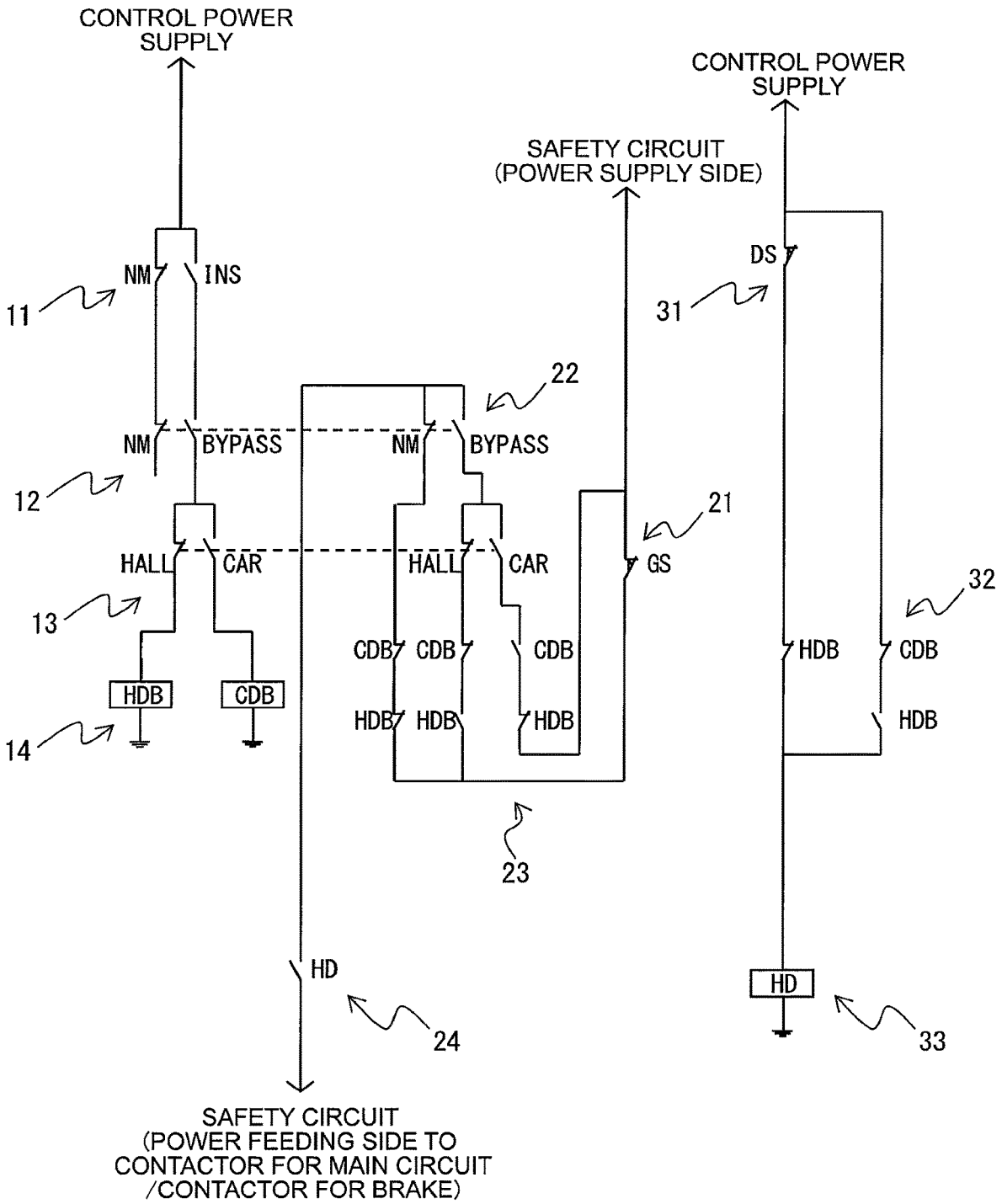
FIG. 2 is a relay circuit diagram for illustrating the elevator door bypass apparatus according to the first embodiment of the present invention.

Now, with reference to FIG. 2 as well as FIG. 1, a description is given of configurations and functions of the respective components of the door bypass manipulation device 10, the door bypass controller 20, and the landing door state determination device 30. FIG. 2 is a relay circuit diagram for illustrating the elevator door bypass apparatus according to the first embodiment of the present invention.

In FIG. 2, the door bypass manipulation device 10, the door bypass controller 20, and the landing door state determination device 30 are illustrated as a circuit in the left column, a circuit in the middle column, and a circuit in the right column, respectively.

Further, the door bypass controller 20 has one end connected to a power supply side of a safety circuit and another end connected to a power feeding side to a contactor for main circuit and contactor for brake of the safety circuit. Further, each of the door bypass manipulation device 10 and the landing door state determination device 30 has one end connected to a control power supply and another end that is grounded.

The inspection switch monitoring unit 11 includes a "NORMAL-INSPECTION" switch, which is an operation mode selector switch, and switches an operation mode between a normal operation and an inspection operation. Power is fed to the elevator door bypass apparatus only when the operation mode is the inspection operation.

The door mode switching unit 12 includes a "NORMAL-BYPASS" switch, which is a door mode selector switch, and switches a door mode between a normal operation and a bypass operation. The door bypass target switching unit 13 includes a "HALL-CAR" switch, which is a bypass target selector switch, and switches a circuit of a landing or car to be bypassed, that is, switches between bypassing of a landing door and bypassing of a car door.

The door bypass actuating unit 14 includes coils of an HDB relay and a CDB relay, which serve as a bypass relay. In a case where the door mode has been switched to the bypass operation by the door mode selector switch, when the bypassing of the landing door has been selected by the bypass target selector switch, the door bypass actuating unit 14 excites the coil of the HDB relay so as to bypass the landing door.

Further, in the case where the door mode has been switched to the bypass operation by the door mode selector switch, when the bypassing of the car door has been selected by the bypass target selector switch, the door bypass actuating unit 14 excites the coil of the CDB relay so as to bypass the car door.

The car door closing monitoring unit 21 includes a GS switch, which is a car door closing detection switch, and monitors whether or not the car door is closed.

The door bypass setting monitoring unit 22 includes a "NORMAL-BYPASS" switch to be switched in association with the door mode selector switch of the door mode switching unit 12, and a "HALL-CAR" switch to be switched in association with the bypass target selector switch of the door bypass target switching unit 13, and monitors the door mode and a door to be bypassed.

The car door bypass unit 23 includes contacts of the HDB relay and the CDB relay, which serve as the bypass relay. In the case where the door mode has been switched to the bypass operation, when the bypassing of the car door has been selected, a circuit for bypassing the car door is formed in the car door bypass unit 23.

The landing door state output unit 24 includes a contact of a landing door closing detection relay. When a coil of the landing door closing detection relay, which is included in the landing door state detection unit 33 of the landing door state determination device 30, is excited, the contact of the landing door closing detection relay is closed to enter a conductive state.

The landing door closing monitoring unit 31 includes a DS switch, which is a landing door closing detection switch, and monitors whether or not all landing doors are closed. Although only one switch is illustrated in FIG. 2, in actuality, switches on respective floors are connected in series.

The landing door bypass unit 32 includes contacts of the HDB relay and the CDB relay, which serve as the bypass relay. In the case where the door mode has been switched to the bypass operation, when the bypassing of the landing door has been selected, a circuit for bypassing the landing door is formed in the landing door bypass unit 32.

The landing door state detection unit 33 includes the coil of the landing door closing detection relay. When all landing doors are closed or when the landing door is bypassed by the landing door bypass unit 32, the coil of the landing door closing detection relay is excited.

In short, the elevator door bypass apparatus described above uses the contacts of the relays and switches that are connected in series or in parallel to the safety circuit and a landing door closing detection circuit to switch the door mode between the normal operation and the inspection operation and to switch the door to be bypassed.

In this case, in the car door bypass unit 23 and the landing door bypass unit 32, an a-contact of a relay for bypassing the door to be bypassed and a b-contact of a relay different from the relay for bypassing the door to be bypassed are connected to each other in series. With this, it is possible to prevent the landing door and the car door from being bypassed at the same time. Moreover, when an ON-failure of the relay different from the relay for bypassing the door to be bypassed occurs, the circuit to be bypassed is not established, and hence the elevator cannot be started, which allows the failure to be recognized.

Further, in a circuit at a time when the door mode has been switched to the normal operation by the door mode selector switch, a b-contact of each relay is inserted into the safety circuit and the landing door closing detection circuit. In this manner, when an ON-failure of a relay occurs, the safety circuit is not established, and hence it is possible to prevent the normal operation.

Further, in order to secure soundness of a circuit provided on the landing door side and a circuit provided on the car door side, the circuit provided on the landing door side and the circuit provided on the car door side are inhibited from being connected to each other in series. As a result, those circuits can be independently monitored.

Further, in order to satisfy the above-mentioned condition "d)", a sensor configured to monitor whether the car door is fully closed may be provided. Further, in order to satisfy the above-mentioned condition "g)", a configuration capable of outputting a signal allowing recognition of the fact that the landing door or the car door is bypassed may be provided.

Next, with reference to FIG. 2, a description is given of an operation of the elevator door bypass apparatus. It is assumed here that the car door closing monitoring unit 21 has detected that all car doors are closed and the landing door closing monitoring unit 31 has detected that all landing doors are closed.

First, in the case of switching the door mode from the normal operation to the bypass operation, the "NORMAL-BYPASS" switch is switched to a "BYPASS" side. Next, in the case of bypassing the landing door, the "HALL-CAR" switch is switched to a "HALL" side. At this time, the coil of the HDB relay is excited, and the circuit for bypassing the landing door is formed.

Further, in the case of bypassing the car door, the "HALL-CAR" switch is switched to a "CAR" side. At this time, the coil of the CDB relay is excited, and the circuit for bypassing the car door is formed.

In this manner, the safety circuit is switched by two switches and the contacts of two relays, and the safety circuit of any one of the car door and the landing door is bypassed. As a result, a state in which the inspection operation can be performed is entered.

As described above, according to the first embodiment, in the case where the door mode has been switched to the bypass operation by the door mode selector switch, the bypass relay bypasses the landing door when the bypassing of the landing door has been selected by the door mode selector switch. Further, in the case where the door mode has been switched to the bypass operation by the door mode selector switch, the bypass relay bypasses the car door when the bypassing of the car door has been selected by the door mode selector switch.

It is therefore possible to satisfy the requirements for the bypassing of the landing door and the car door with an inexpensive configuration.

The invention claimed is:

1. An elevator door bypass apparatus, which is configured to bypass a landing door or a car door at a time of an inspection of an elevator, the elevator door bypass apparatus comprising:

a door mode selector switch configured to switch a door mode between a normal operation and a bypass operation;

a bypass target selector switch configured to switch between bypassing of the landing door and bypassing of the car door; and a bypass relay configured to, in a case where the door mode has been switched to the bypass operation by the door mode selector switch, bypass the landing door when the bypassing of the landing door has been selected by the bypass target selector switch, and bypass the car door when the bypassing of the car door has been selected by the bypass target selector switch.

2. The elevator door bypass apparatus according to claim 1, wherein, in the bypass relay, an a-contact for a relay for bypassing the door to be bypassed and a b-contact for a relay different from the relay for bypassing the door to be bypassed, are connected to each other in series.

3. The elevator door bypass apparatus according to claim 1, wherein, in a circuit in a case where the door mode has been switched to the normal operation by the door mode selector switch, a b-contact for a relay for bypassing the door to be bypassed and a b-contact for a relay different from the relay for bypassing the door to be bypassed are connected to each other in series.

4. The elevator door bypass apparatus according to claim 1, wherein, in the bypass relay, a circuit provided on the landing door side and a circuit provided on the car door side are disconnected from each other.

5. The elevator door bypass apparatus according to claim 2, wherein, in a circuit in a case where the door mode has been switched to the normal operation by the door mode selector switch, a b-contact for a relay for bypassing the door to be bypassed and a b-contact for a relay different from the relay for bypassing the door to be bypassed are connected to each other in series.

6. The elevator door bypass apparatus according to claim 2, wherein, in the bypass relay, a circuit provided on the landing door side and a circuit provided on the car door side are disconnected from each other.

7. The elevator door bypass apparatus according to claim 3, wherein, in the bypass relay, a circuit provided on the landing door side and a circuit provided on the car door side are disconnected from each other.

8. The elevator door bypass apparatus according to claim 5, wherein, in the bypass relay, a circuit provided on the landing door side and a circuit provided on the car door side are disconnected from each other.

* * * * *